US007797830B2

(12) United States Patent
Rörig et al.

(10) Patent No.: US 7,797,830 B2
(45) Date of Patent: Sep. 21, 2010

(54) METHOD OF MAKING AN OUTER LEVER OF A SWITCHABLE FINGER LEVER

(75) Inventors: Bodo Rörig, Weisendorf (DE); Peter Spitzer, Emskirchen (DE)

(73) Assignee: Schaeffler KG, Herzogenaurach (DE)

( * ) Notice: Subject to any disclaimer, the term of this patent is extended or adjusted under 35 U.S.C. 154(b) by 985 days.

(21) Appl. No.: 10/563,851

(22) PCT Filed: Jun. 2, 2004

(86) PCT No.: PCT/EP2004/005921

§ 371 (c)(1),
(2), (4) Date: Nov. 10, 2006

(87) PCT Pub. No.: WO2005/005787

PCT Pub. Date: Jan. 20, 2005

(65) Prior Publication Data

US 2007/0067989 A1 Mar. 29, 2007

(30) Foreign Application Priority Data

Jul. 9, 2003 (DE) ..... 103 30 882

(51) Int. Cl.
*B21K 1/12* (2006.01)
*F01L 1/18* (2006.01)

(52) U.S. Cl. ..... 29/888.2; 123/90.39; 123/90.41

(58) Field of Classification Search ..... 29/557, 29/558, 890, 890.126, 890.128, 890.132, 29/888.2; 123/90.39
See application file for complete search history.

(56) References Cited

U.S. PATENT DOCUMENTS

| | | | | |
|---|---|---|---|---|
| 3,855,981 | A | 12/1974 | Loon | |
| 4,825,717 | A | 5/1989 | Mills | |
| 5,048,475 | A | 9/1991 | Mills | |
| 5,259,346 | A | 11/1993 | Mills | |
| 5,544,626 | A | 8/1996 | Diggs et al. | |
| 5,720,245 | A * | 2/1998 | Calka | 123/90.41 |
| 5,819,694 | A * | 10/1998 | Trutescu et al. | 123/90.43 |
| 6,508,215 | B2 * | 1/2003 | Okubo et al. | 123/90.41 |
| 6,588,101 | B2 * | 7/2003 | Okubo et al. | 29/888.2 |
| 6,601,555 | B2 * | 8/2003 | Okubo et al. | 123/90.39 |
| 7,360,290 | B2 * | 4/2008 | Nozaki et al. | 29/34 R |

FOREIGN PATENT DOCUMENTS

| | | |
|---|---|---|
| DE | 27 53 197 A | 6/1978 |
| DE | 39 29 486 C | 3/1990 |
| DE | 196 18 417 A | 11/1997 |
| DE | 196 31 653 A | 2/1998 |

(Continued)

*Primary Examiner*—David P Bryant
*Assistant Examiner*—Jacob J Cigna
(74) *Attorney, Agent, or Firm*—Charles A. Muserlian

(57) ABSTRACT

According to the present invention, an outer lever (1) of a finger lever (2) that can be switched to different lifts for at least one gas exchange valve is made by a deep drawing method. A salient feature of the invention is that through a special trimming operation of the cup-shaped base body (16) that is formed in a first step of the method, running contact surfaces (14, 15) for cams, preferably high-lift cams, are generated on upper sides (12, 13) of arms (4, 5) of the outer lever (1). Through the deep drawing method of the invention, only relatively low fabrication costs are to be expected.

8 Claims, 2 Drawing Sheets

FOREIGN PATENT DOCUMENTS

| | | | | |
|---|---|---|---|---|
| DE | 197 10 867 | A | | 9/1998 |
| DE | 198 16 020 | A | | 10/1999 |
| DE | 199 50 990 | A | | 8/2000 |
| DE | 100 59 545 | A | | 6/2002 |
| EP | 0 573 674 | B | | 12/1993 |
| EP | 0 735 249 | A | | 1/1996 |
| GB | 20 20 389 | A | | 11/1979 |
| JP | 06159018 | A | * | 6/1994 |

* cited by examiner

METHOD OF MAKING AN OUTER LEVER OF A SWITCHABLE FINGER LEVER

FIELD OF THE INVENTION

This application is a 371 of PCT/EP2004/005921 filed Jun. 2, 2004

The invention concerns a method of making an outer lever of a finger lever that can be switched to different lifts for at least one gas exchange valve, said outer lever comprising two substantially parallel arms whose ends are connected by crossbars so that a rectangular or O-like aperture for an inner lever that is capable of pivoting relative to the outer lever is formed, a running contact surface for a high-lift cam being arranged on an upper side of each arm.

BACKGROUND OF THE INVENTION

The use of switchable finger levers of the pre-cited type made after the lever-in-lever principle is constantly increasing because, while offering a variability of the valve train, they necessitate only relatively insignificant modifications to prior art cylinder heads and their surrounding structures. The basic principle of such finger levers is known, for instance, from DE-OS 27 53 197 and U.S. Pat. No. 5,544,626.

The outer levers of switchable finger levers are made in the prior art by casting or similar creative forming methods. Fabrication by a casting method is relatively complex and therefore also expensive. In addition, as a rule, a lever made by casting is relatively heavy and thus has a detrimental effect on the friction and the oscillating masses in the valve train.

OBJECTS OF THE INVENTION

It is an object of the invention to provide an economic method of making an outer lever for a switchable finger lever.

This and other objects and advantages of the invention will become obvious from the following detailed description.

SUMMARY OF THE INVENTION

The invention achieves the above objects by a method comprising the following steps:

a) deep drawing a cup-shaped base body out of a metal sheet or a sheet metal strip such that, on the one hand, a drawing die is applied to the metal sheet or the sheet metal strip from one side of the upper sides of the arms and the crossbars to be formed and produces a substantial height of the arms and the crossbars in the cup-shaped base body and, on the other hand, a continuous annular collar comprising the upper sides extends outwards approximately at right angles to the base body, b) simultaneous or subsequent shaping, typically stamping of an approximately central cavity extending in a length direction of the lever in an underside of one of the crossbars, c) punching-out a bottom of the cup-shaped base body, and d) cutting-off the continuous annular collar on the upper sides except for two elongate opposing projecting portions on the arms for forming the running contact surfaces.

An outer lever made by this method can be manufactured relatively economically. Particularly in mass production, and that is the focus here, a change-over from castings to deep drawn sheet metal results in an excellent reduction of costs.

It goes without saying that the cup-shaped base body can also be given its intended depth in several drawing steps. In the case of sheet metal strip, the entire final geometry can be created on a multi-step stamping and bending machine.

The stamping operation of step b) is intended to serve only as an example for configuring the cavity. Other methods such as extrusion, machining and the like will also occur in this connection to a person skilled in the art. The cavity serves as an upper support for a longitudinally displaceable coupling element that is completely accommodated in the inner lever in the uncoupled state. For the basic principle of longitudinal locking reference can be made, for instance, to U.S. Pat. No. 5,544,626. It goes without saying that this step of the method can be omitted in the case of crosswise locking.

It is likewise clear that further method steps can also be added before, between and after those proposed by the invention. Moreover, a final geometry of the arms and crossbars may also be realized through the use of additional tools, preferably shaping tools, applied to their outer sides.

As soon as the bottom has been punched out in step c), the arms and the crossbars have their basic height and geometry. Possibly necessary finishing steps, however, will not be discussed further in the present context.

A particular advantage of the invention is that through the cutting-off operation of the method step d), the running contact surfaces for the cams are created without additional measures. It is preferably intended to create running contact surfaces for high-lift cams. It is also conceivable and intended to provide a running contact surface only on one of the arms if only one lifting cam is to be applied to the outer lever.

The finger-like extension provided according to one proposition of the invention on one of the crossbars, which extension is bent upwards through approximately 90° after being punched out, serves to prevent an undesired outward motion of the aforesaid longitudinally displaceable coupling element in the inner element when the outer lever is uncoupled from the inner lever (low or zero lift).

According to a further advantageous proposition of the invention, the annular collar is cut off completely except for the running contact surfaces and, if required, the aforesaid extension. In this way, the upper sides of the outer lever merge directly, through a "smooth surface", into the respective outer surfaces of the arms and the crossbars.

It is further proposed that the cavity on one of the crossbars be made with a partially cylindric configuration. If, however, the coupling element in the inner element has a shape other than a piston-like shape, this cavity may have other configurations such as a rectangular shape etc. What is important is that a good osculation and thus a low surface pressure of the coupling element on the underside of the crossbar concerned is obtained in the coupled state.

Due to the cylindrical configuration of the running contact surfaces according to a further proposition of the invention, it is possible to reduce the length of these surfaces if desired or necessary. An excellent cam contact is likewise guaranteed through this configuration.

According to a further advantageous feature of the invention, the running contact surfaces formed in step d) extend approximately at the center of the arms. "Center" in the present context relates to the longitudinal dimension of the outer lever. If necessary, an off-center configuration, preferably further away from the point of pivot of the outer lever, is also conceivable.

Advantageously, a further step e) can follow the method step d). In this further step, it is proposed to make two aligned receptions for an axle for the pivotal mounting of the inner lever relative to the outer lever, by punching or boring or the like.

If desired or necessary, the crossbar not comprising the support for the coupling element in the region of its underside can be omitted.

The invention will now be described more closely with reference to the appended drawing.

DETAILED DESCRIPTION OF THE DRAWING

Figure 1:
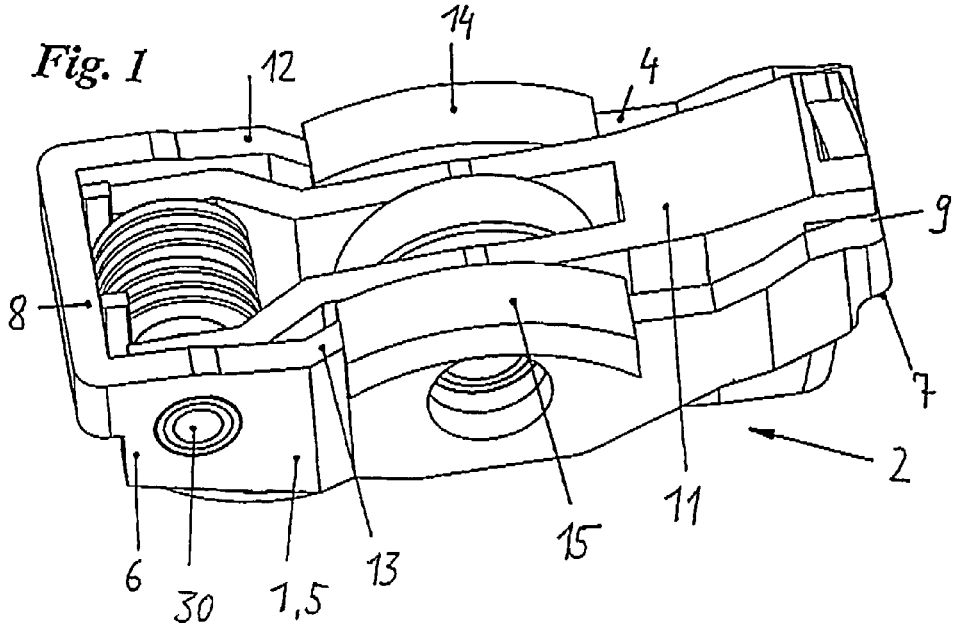
FIG. 1 is a perspective view of a finger lever comprising an outer lever and an inner lever.

The finger lever 2 (see FIG. 1) comprises an outer lever 1 which encloses in its aperture 10, an inner lever 11 that is capable of pivoting relative to the outer lever 1. The two levers 1, 11 are mounted on a common axle 30 in the region of one end 6.

The outer lever 1 comprises two substantially parallel arms 4, 5 that are connected through a crossbar 8, 9 at each of their ends 6, 7. Therefore, as seen in a top view, the outer lever 1 has a rectangular or O-like geometry. The upper side 12, 13 of each arm 4, 5 comprises a running contact surface 14, 15 for a cam. On the side of the end 7, the inner lever 11 comprises a longitudinally displaceable slide, not shown, that can be pushed under an underside 21 of the crossbar 9 of the outer lever 1 (s. also FIG. 4) for coupling the levers 1, 11. For this purpose, the underside 21 comprises a fine-machined cavity 20 whose shape is complementary to that of the outer peripheral surface of the aforesaid slide.

Figure 2:
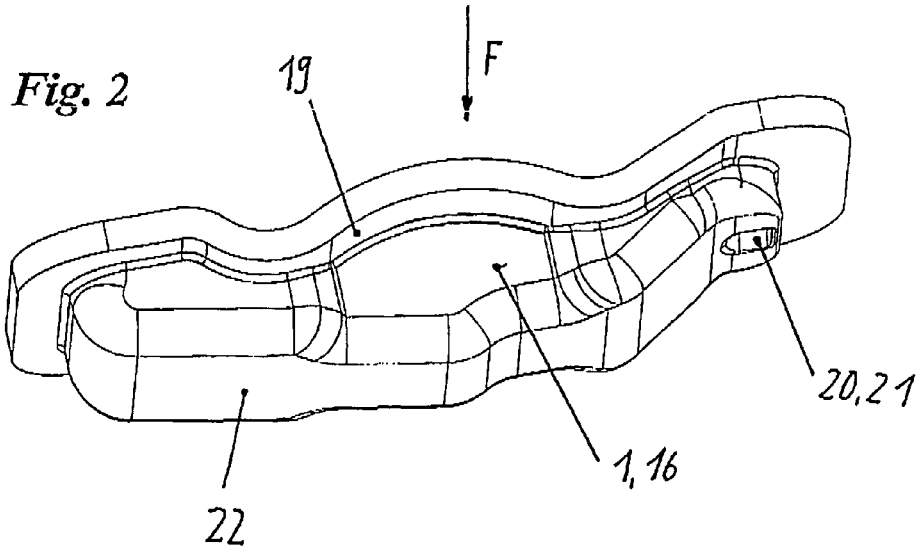
FIG. 2 is a view of the outer lever at one stage of its fabrication.
Figure 3:
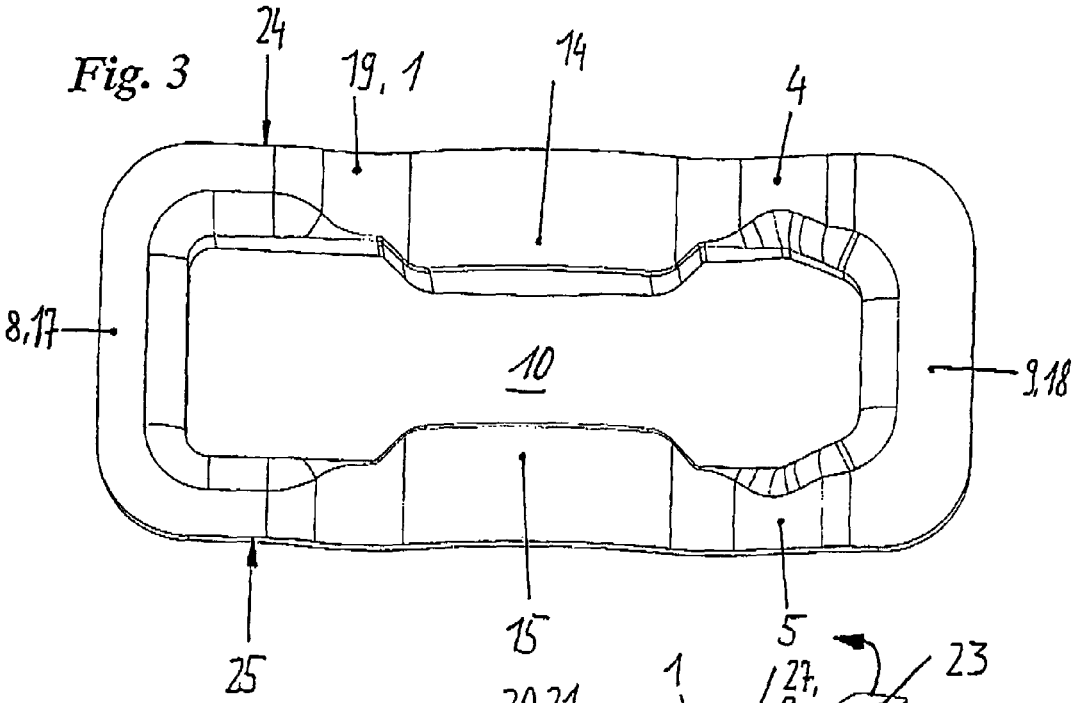
FIG. 3 is a view of the outer lever at another stage of its fabrication.

The method of the invention for making the outer lever 1 is described more closely in the following:

Starting from a metal sheet or a sheet metal strip, a cup-shaped base body is deep-drawn in a first step of the method (see FIG. 2). The arrow "F" in FIG. 2 identifies the direction of application of the at least one deep-drawing die. During the drawing operation, the substantial height of the arms 4, 5 and the crossbars 8, 9 is generated in the base body 16 in at least one step. The base body 16 is then trimmed such that a continuous annular collar (see FIGS. 2, 3) containing the upper sides 12, 13, 17, 18 projects therefrom. Following this, if it was not already possible in the preceding step of the method, the cavity 20 is made on the underside 21 of the one crossbar 9, for instance, by stamping.

Figure 4:
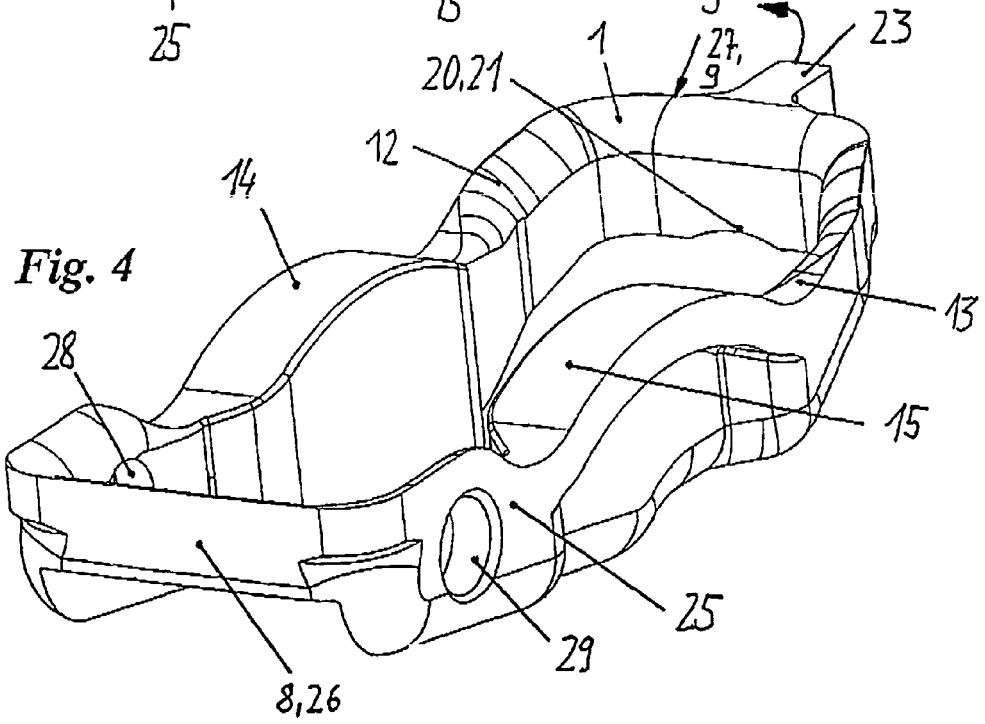
FIG. 4 is a view of the outer lever at still another stage of its fabrication.

Following this, a bottom 22 of the cup-shaped base body 16 is punched out. This can best be seen in FIGS. 3 and 4. Finally, but this must not be the last step of the method, the aforesaid continuous annular collar 19 is cut off except for the two projecting portions for forming the running contact surfaces 14, 15. In this way, an outer lever 1, as basically disclosed in FIG. 4, is formed. Although FIG. 4 does not explicitly show that the edge 19, as shown in FIG. 1, is cut off such that the running contact surfaces 14, 15 project outwards, this is still the preferred embodiment.

If necessary, the edge 19 can be cut off in such a way that an extension 23 is left over on the crossbar 9 (s. FIG. 4), which extension 23 is bent upwards through approximately 90°, in the present case in anti-clockwise direction, in a further step of the method.

As can be seen particularly in FIG. 4, the annular collar 19 is cut off with a "smooth surface", so that the upper sides 12, 13, 17, 18 of the arms 4, 5 and the crossbars 8, 9 merge substantially directly into the corresponding outer surfaces 24, 25 26, 27. If, however, for reasons of rigidity or the like, it is necessary to leave more material in place in this region, the person skilled in the art is free to do so.

Finally, a further method step can follow in which two aligned receptions 28, 29 are punched or bored into the arms 4, 5 in the vicinity of the crossbar 8. These receptions 28, 29 serve to receive the aforesaid axle 30.

As can be clearly seen in FIGS. 1, 4, the running contact surfaces 14, 15 on the arms 4, 5 have a slightly cylindrical shape as viewed in longitudinal direction. This shape is advantageously produced without chip removal during the shaping operation of the outer lever 1.

The invention claimed is:

1. A method of making an outer lever of a finger lever that can be switched to different lifts for at least one gas exchange valve, said outer lever comprising two substantially parallel arms whose ends are connected by crossbars so that a rectangular or O-like aperture for an inner lever that is capable of pivoting relative to the outer lever is formed, a running contact surface for a high-lift cam being arranged on an upper side of each arm, said method comprising the following work steps to which further intermediate steps may be added:

a) deep drawing a cup-shaped base body out of a metal sheet or a sheet metal strip such that, on the one hand, a drawing die is applied to the metal sheet or the sheet metal strip from one side of the upper sides of the arms and crossbars to be formed and produces the substantial height of the arms and the crossbars in the cup-shaped base body and, on the other hand, a continuous annular collar comprising the upper sides extends outwards approximately at right angles to the base body;

b) simultaneous or subsequent shaping, typically stamping of an approximately central cavity extending in length direction of the lever in an underside of one of the crossbars:

c) punching-out a bottom of the cup-shaped base body, and d) cutting-off the continuous annular collar on the upper sides except for at least two elongate opposing projecting portions on the arms for forming the running contact surfaces;

wherein the annular collar is cut off in step d) such that, in addition to the running contact surfaces of the arms, a finger-like extension remains on the crossbar comprising the cavity, which extension extends longitudinally away from the crossbar and is subsequently bent over so as to project from the upper side of the crossbar.

2. A method of claim 1, wherein the annular collar is cut off in step d) such that outer surfaces of the arms and the crossbars merge directly or approximately directly into the upper sides.

3. A method of claim 1, wherein the cavity of step b) is partially cylindrical in shape.

4. A method of claim 1, wherein the running contact surfaces made in step d) have a beam-like geometry and, as viewed in longitudinal direction, a slightly cylindrical shape.

5. A method of claim 1, wherein the running contact surfaces made in step d) extend approximately at a center of the arms.

6. A method of claim 1, wherein step d) is followed by a further step e) in which two aligned receptions are punched or bored into the arms in the vicinity of the crossbar that is opposed to the crossbar comprising the finger-like extension, and said receptions serve to receive an axle for the pivoted mounting of the inner lever relative to the outer lever.

7. A method of claim 1, wherein the running contact surface on each arm of the outer lever is intended for a contact with a high-lift cam.

8. A method of claim 4 wherein the running contact surfaces made in step d) extend approximately at a center of the arms.

* * * * *